United States Patent [19]

Hammelmann

[11] Patent Number: 4,784,330

[45] Date of Patent: Nov. 15, 1988

[54] HIGH PRESSURE SPRAYING GUN

[76] Inventor: Paul Hammelmann, Zum Sundern 17, 4740 Oelde 1, Fed. Rep. of Germany

[21] Appl. No.: 47,865

[22] Filed: May 8, 1987

[30] Foreign Application Priority Data

May 23, 1986 [DE] Fed. Rep. of Germany ..... 3617424

[51] Int. Cl.[4] ..... B05B 11/00

[52] U.S. Cl. ..... 239/526; 222/402.11; 251/99; 239/DIG. 22

[58] Field of Search ..... 251/229, 279, 99, 102; 239/DIG. 22, 525–528; 222/402.11

[56] References Cited

U.S. PATENT DOCUMENTS 1,318,120 10/1919 Wheaton ..... 251/109
2,919,071 12/1959 Dalton ..... 239/525 X
3,356,149 12/1967 Billings ..... 239/525 X
4,216,911 8/1980 Huperz ..... 239/526
4,432,483 2/1984 Kuck ..... 239/525 X

*Primary Examiner*—Douglas C. Butler
*Assistant Examiner*—Kevin Patrick Weldon
*Attorney, Agent, or Firm*—Laubscher & Laubscher

[57] ABSTRACT

A high pressure spraying gun has a jet pipe, a pressure water supply element, two trigger levers for right-handed and left-handed actuation, and only one blocking valve arranged to selectively block and to release pressure water through flow through the jet pipe or through the pressure water supply element and including a valve body, a spring which biases the valve body in a first direction, and a rocking member having two ends spaced from one another in a second transverse direction, so that the blocking valve can be opened only under the simultaneous action of two trigger levers on both ends of the rocking member.

13 Claims, 4 Drawing Sheets

HIGH PRESSURE SPRAYING GUN

The present invention relates to a high pressure spraying gun. More particularly, it relates to such a high pressure spraying gun which has a jet pipe, a pressure water supplying element, blocking means operative for selectively blocking and releasing pressure water throughflow through the jet pipe or through the pressure water supplying element, and two trigger levers which cooperate with the blocking means so that it is released only when both trigger levers act simultaneously on the blocking means.

For cleaning of surfaces with pressure water, pressure water with a working pressure of above 80 bar is used in increasing volume, also for the purpose of efficiency increase. With such high pressure, the pressure water produces a cutting action which poses a high danger of injuries. Therefore safety measures must be taken in the high pressure spraying gun.

Moreover, during the operation of the high pressure spraying gun high recoil forces act on the user. They depend on the drive power of the used pressure water generator, and with a further increase of the water pressure can reach such values which make safe and trouble-free manual operation impossible.

For reducing the risk of handling the high pressure spraying guns, it was proposed to use two trigger levers which ensure the safety of both hands, since the operation of the spraying gun is possible only when both trigger levers are actuated by two hands. Such high pressure spraying guns are manufactured by the Hammelman company. In these spraying guns a first blocking valve is actuated by the first trigger lever, and in addition a second blocking valve is provided and can be opened by the second trigger lever. A release of the pressure water jet is carried out only when both trigger levers are pulled jointly and open both blocking valves.

The construction of this high pressure spraying gun is such that an auxiliary valve is arranged between two blocking valves and used for actuating the respective blocking valve by the respective trigger lever. This high pressure spraying gun is of an expensive construction, especially because of the manufacture and mounting of the auxiliary valve. It has a high cost of production for this reason, and also because two blocking valves are used in it. Moreover, a high number of parts in this spraying gun involves frequent repairs which leads to costly interruptions of its operation.

A further disadvantage of the known high pressure spraying gun is that the switching of the positions of the trigger levers for right-handed and left-handed operation from ergonomic reasons is not possible therein.

SUMMARY OF THE INVENTION

Accordingly, it is an object of the present invention to provide a high pressure spraying gun which avoids the disadvantages of the prior art.

More particularly, it is an object of the present invention to provide a high pressure spraying gun which is designed so that, with structurally simple means, it provides for a safe and functionally reliable two-hand operation, is cost-effective in manufacture and maintenance, and has an increased operational safety.

In keeping with these objects and with others which will become apparent hereinafter, one feature of the present invention resides, briefly stated, in a high pressure spraying gun which has a jet pipe, a pressure water supply element, two trigger levers for right-handed and left-handed actuation, and a single blocking valve which has a valve body biased by a spring in a first direction, and a rocking member extending in a second direction which is transverse to the first direction, and which has two end regions spaced from one another in the second direction, so that the blocking valve can be released only when both trigger levers simultaneously act upon both end regions of the rocking member, and only then pressure water can be discharged from the high pressure spraying gun.

When the high pressure spraying gun is designed in accordance with the present invention, and particularly has only one blocking valve, in any and all circumstances a release of the pressure water throughflow is possible only when both trigger levers are actuated simultaneously. It is, for example, impossible that during actuation of the second trigger lever, residual water is discharged, as was the case in the existing spraying guns. The safety of the whole system is thereby increased.

With respect to the frequency of repairs, a significant advantage is also obtained because of the simple construction principle which no longer requires the use of a plurality of movable parts.

In accordance with an advantageous feature of the present invention, the free end of the valve body is fork-shaped, and the rocking member is held between the arms of the fork by means of a throughgoing pivot pin. This type of suspension for the rocking member provides for an especially high stability.

With the simultaneous action of two trigger levers on the blocking valve, the force which is applied to each trigger lever is half the force required for overcoming the counterforce of the pressure spring, which biases the blocking valve. Therefore, the additional advantage of the inventive high pressure spraying gun is that a significantly more convenient handling is possible, without the user experiencing any high loads.

The novel features of the present invention are set forth in particular in the appended claims. The invention itself, however, both as to its construction and its manner of operation, will be best understood from the following description of preferred embodiments, which is accompanied by the following drawings .

DESCRIPTION OF A PREFERRED EMBODIMENT

Figure 1:
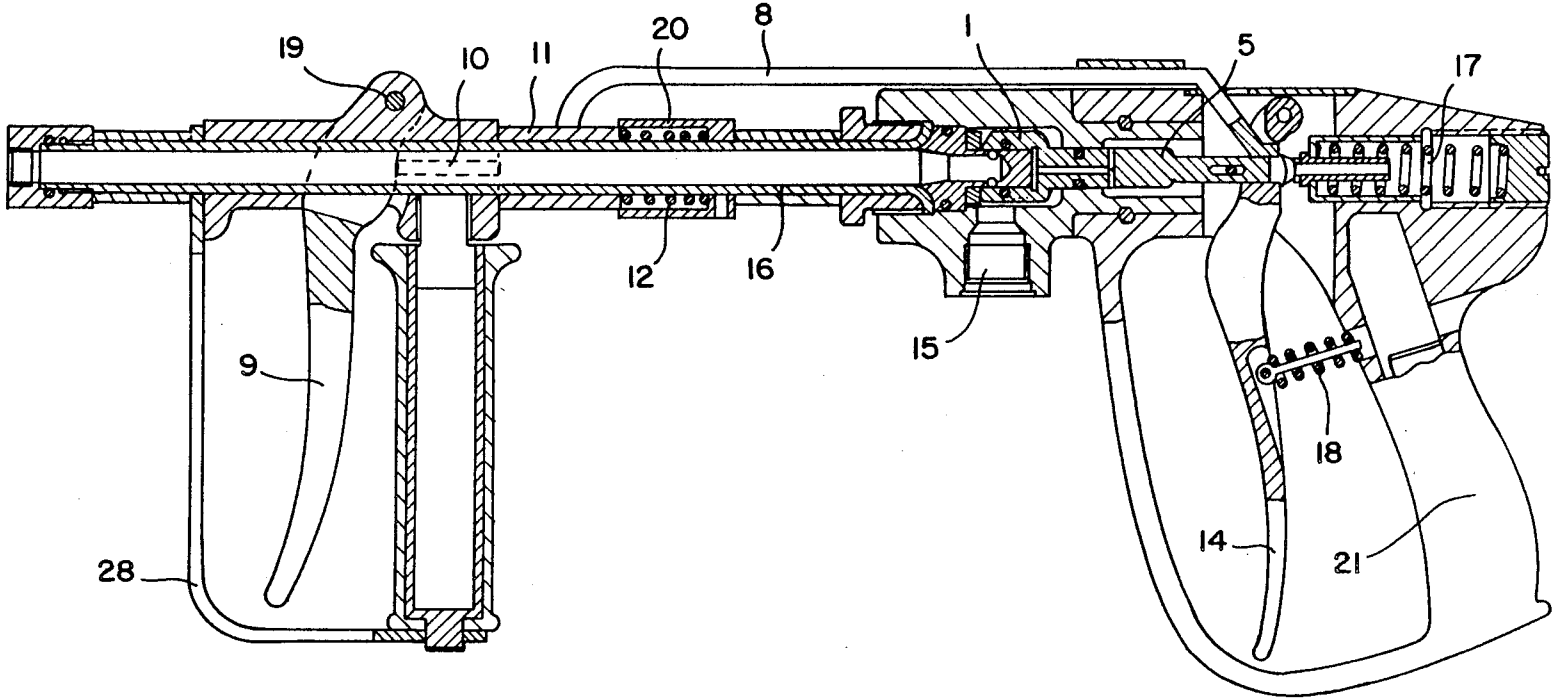
FIG. 1 is an elevation view in part-section showing a high pressure spraying gun in accordance with the present invention.

A high pressure spraying gun is shown in FIG. 1 and has a pressure water supply connection means 15 and a jet pipe 16 connected with the latter. A blocking valve 1 is arranged between the pressure water supply connection means 15 and the jet pipe 16. Its valve member 5 is biased by a pressure spring 17.

The spraying gun has two trigger levers 9 and 14 for left-handed and right-handed actuation. For safety reasons, the spraying gun is designed so that its operation can be started only when both trigger levers 9 and 14 are actuated simultaneously. During the actuation of only one lever 9 or 14, the blocking valve remains closed and the throughflow of the pressure water through the water supply element 15 or the jet pipe 16 is blocked.

The trigger lever 9 is mounted turnably on a pivot axle 19 and is coupled with a sleeve 11 via a plunger 10. The sleeve 11 is connected with a lever rod 8 which extends to the region of the blocking valve 1. The sleeve 11 is guided on the jet pipe 16 and has an end face which is opposite to the plunger 10 and abuts against a pressure spring 12. The pressure spring 12 is also guided on the jet pipe 16 and is maintained stationary in a housing 20. With this construction, during actuation of the trigger lever 9, the sleeve 11 is pressed by the pressure spring 12 via the plunger 10, so that the pressure spring 12 is compressed. The compressed pressure spring 12 returns the trigger lever 9 to its initial position, after the end of the actuation, and then holds the trigger lever 9 under pretension, so that the trigger lever 9 is prestressed.

The other trigger lever 14 is also held under pretensioning by a pressure spring 18. The spring 18 abuts against a handle 21, on the one hand, and the trigger lever 14, on the other hand.

Figure 2:
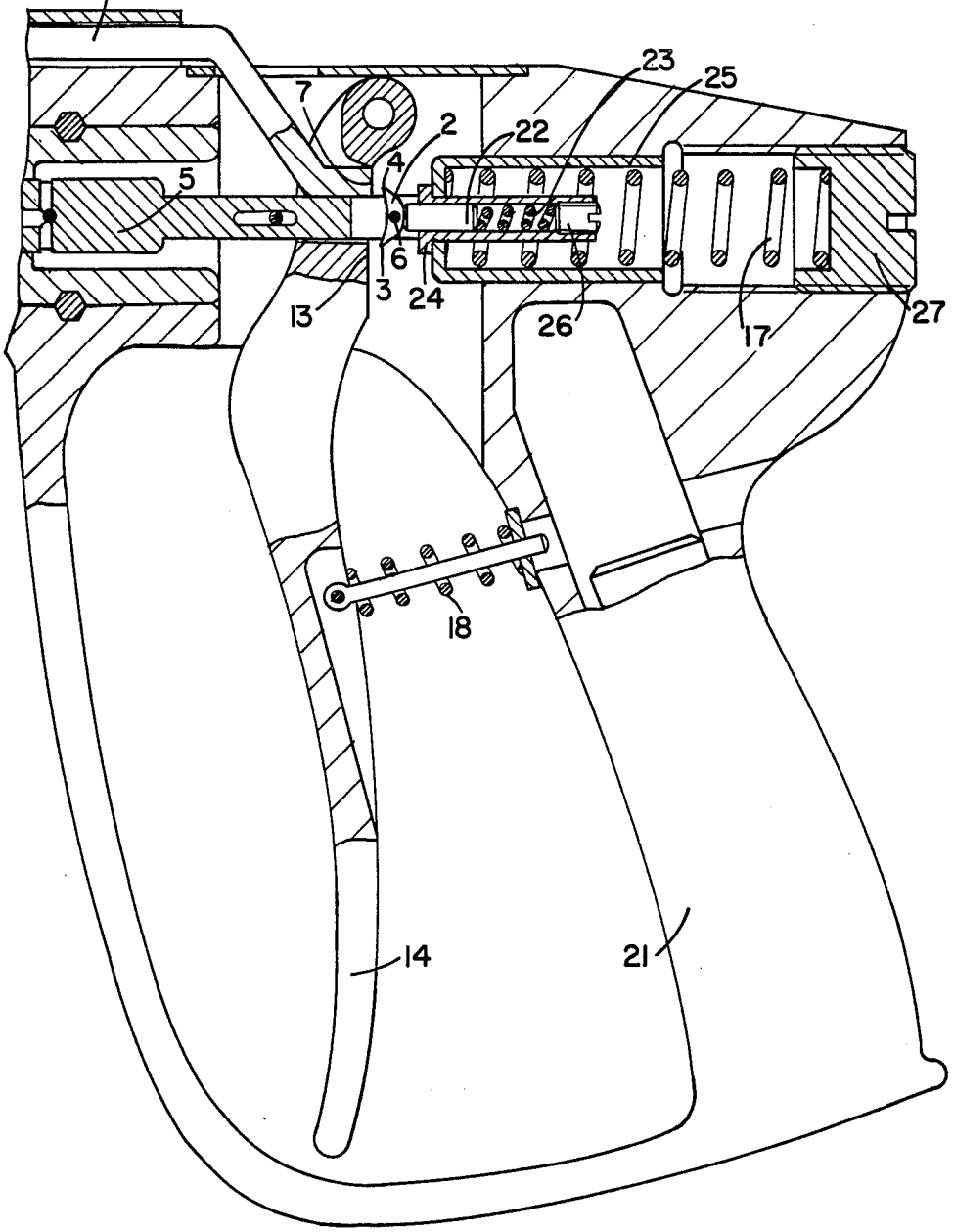
FIG. 2 is a view showing the inventive high pressure spraying gun in a position in which it is actuated with two hands.

FIGS. 1 and 2 show the position of the high pressure spraying gun, in which both trigger levers are actuated. A rocking member 2 is arranged on the valve body 5 and particularly on its free end, which faces away from the jet pipe 16. This free end is fork-shaped, and the rocking member 2 is arranged rotatably or turnably on a pivot pin 6 between the arms of the fork. The rocking member 2 has a side which is opposite to the valve member 5 and abuts with this side against an end face of a pin 22. The pin 22 is guided in a sleeve 24 and has another end face which forms an abutment face for a helical spring 23. The helical spring 23 is held in the sleeve 24 by a stud screw 26. Under the action of the spring force which acts on the rocking member 2 via the pin 22, the rocking member is always advantageously held in unloaded condition in a predetermined position. This prevents an uncontrolled turning movement of the rocking member. With simultaneous actuation of the trigger levers 9 and 14, the lever rod 8 is displaced by the trigger lever 9 in the longitudinal direction of the valve body 5 and its end face 7 engages with an abutment face 4 of the rocking member 2 or, in other words, engages one end of the rocking member 2. On the other hand, an end face 13 of the trigger lever 14 also engages with an abutment face 3 thereof the rocking member 2, or in other words, engages the other end of the rocking member.

During this simultaneous abutment of the end face 7 of the lever rod 8 and the end face 13 of the trigger lever 14, the rocking member 2 remains in the position of equilibrium, so that the displacement of the valve body 5 in an axial direction can be carried out against the spring force of the pressure spring 17. The pressure spring 17 abuts against the bottom of a cup-shaped bush 25, on the one hand, and against an end face of a screw 27, on the other hand. The sleeve 24 extends through the bottom of the bush 25, and has a flange which projects outwardly through the bottom and abuts against the outer side of the bush 25.

The free end of the valve body 5 is also supported in this region of the bush 25. In the shown embodiment, the end faces of the fork legs of the valve body 5 are supported in this region of the bush 25. During the axial displacement of the valve body 5, the path between the pressure water supply connection means 15 and the jet pipe 16, which was blocked by the blocking valve 1, is released. Thereby a free throughflow of the pressure water becomes possible.

Figure 3:
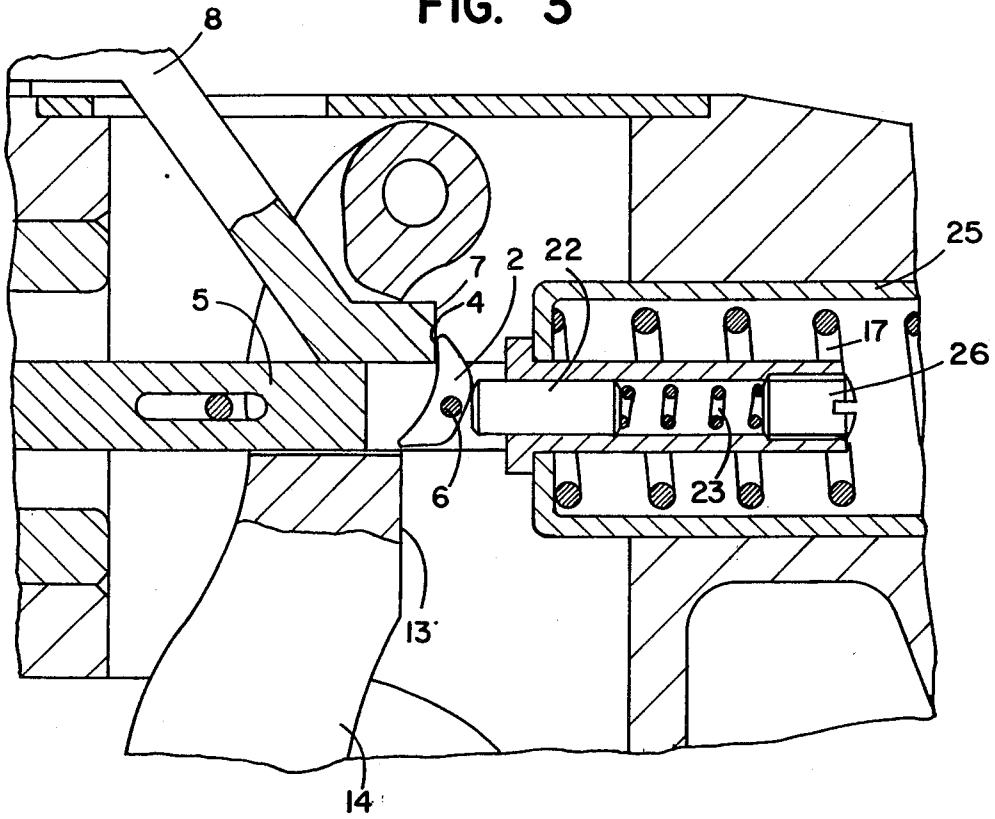
FIGS. 3 and 4 are views showing the inventive spraying gun in positions in which it is actuated by one of the user's hands .
Figure 4:
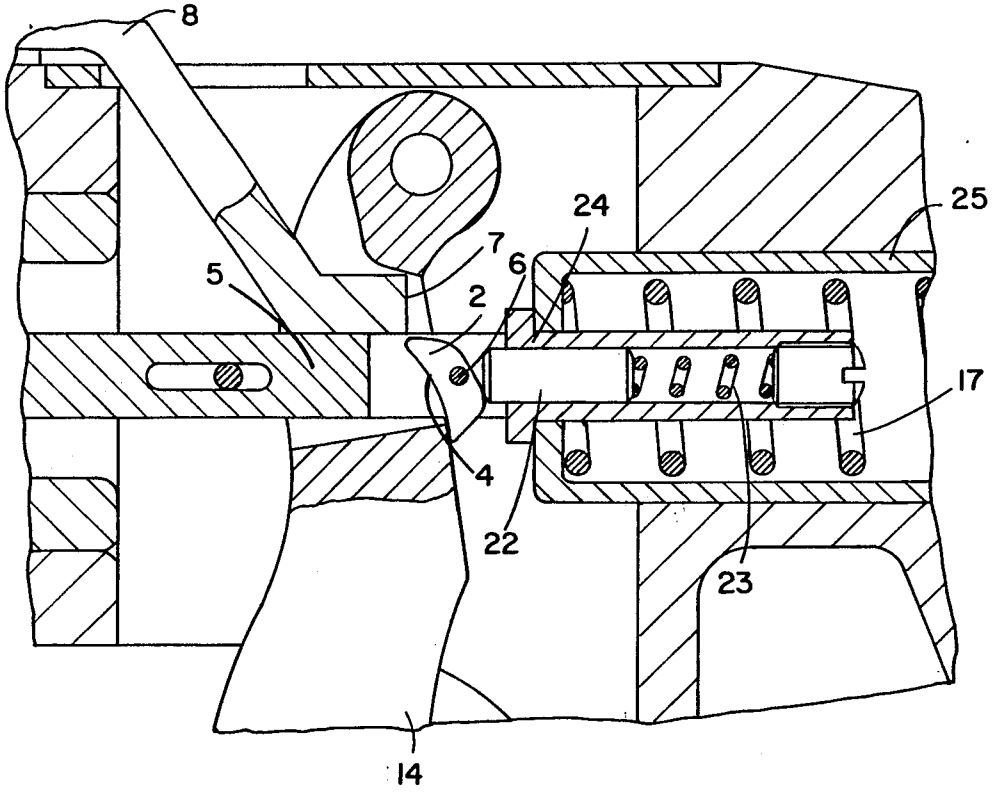

When in contrast thereto, only one of the trigger levers 9 and 14 is actuated, as shown in FIGS. 3 and 4, the rocking member 2 is loaded on one side only. Thereby it is no longer available for force transmission and therefore for a longitudinal displacement of the valve member 5, so that the blocking valve 1 remains closed. FIG. 3 shows the position of the rocking member 2 during actuation of the trigger lever 9, in which the rocking member 2 is turned about the pin 6 by the lever rod 8. On the other side the distance between the outer edge of the rocking member 2 and the pin 6 is smaller than the minimum distance from the abutment face 13 of the trigger lever 14 to the pin 6 of the rocking member 2 in the initial position of the trigger lever 14.

The same is true for the distance of the outer edge of the abutment surface 4 of the rocking member 2 and the minimum distance from the end face 7 of the lever rod 8 to the pin 6. Thereby it is guaranteed that the rocking member 2 runs freely when only one of the trigger levers 9 and 14 is actuated and therefore the safety measures are implemented in the desired manner.

The actuation of the trigger lever 14 only is shown in FIG. 4. It can be clearly seen that the rocking member 2 is tilted to one side, and the release of the valve 1 under the action of the axial displacement of the valve member 5 is prevented by the above described free running.

As can be seen in particular in FIG. 1, the front trigger lever 9 is at least partially turnable, together with a safety bracket 28, about the jet pipe 16. This feature ensures that the high pressure valve in accordance with the present invention can be used simultaneously by right-handed and left-handed users.

The invention is not limited to the details shown, since various modifications and structural changes are possible without departing in any way from the spirit of the present invention.

What is desired to be protected by Letters Patent is set forth in particular in the appended claims.

I claim:

1. A high pressure spraying gun, comprising:

(a) a jet pipe for discharging pressure water;

(b) pressure water supply means for supplying pressure water to said jet pipe;

(c) blocking means for selectively blocking and releasing a pressure water throughflow path between said jet pipe and said pressure water supply means, respectively; and (d) two trigger levers adapted for right-handed and left-handed actuation, respectively, said levers being arranged to act on said blocking means so as to selectively block and release said pressure water throughflow path between said jet pipe and said pressure water supply means, respectively;

(e) said blocking means including a single blocking valve having a valve body, spring means biasing said valve body in a first direction, and a rocking member pivotably mounted on said valve body so that it extends in an unloaded condition in a second direction which is transverse to said first direction, said rocking member having two end regions spaced from one another in said transverse direction and cooperating with said trigger levers so that said blocking valve can open said pressure water through-flow path only when both said trigger levers simultaneously act on both said end regions of said rocking member, thereby to prevent high pressure spraying when only one of said trigger levers is actuated, (f) at least one of said trigger arms being arranged so that it is engageable with one of said end regions of said rocking member, (g) said rocking member being pivotable about a pivot point and having end faces in said end regions, said one of said trigger arms having an abutment face which is arranged to abut against one of said end faces of said rocking member, and has a minimum distance to said pivot point, which is greater than a maximum distance from said end face in said one end region to said pivot point of said rocking member.

2. A high pressure spraying gun as defined in claim 1, wherein said valve body has a free end which is fork-shaped and has two fork legs, said rocking member being held between said fork legs.

3. A high pressure spraying gun as defined in claim 1, wherein at least one of said trigger levers is turnable in a predetermined turning direction; and further comprising a handle; and a pressure spring extending between said one trigger lever and said housing in said turning direction and having two ends abutting against said one trigger arm and said handle, respectively.

4. A high pressure spraying gun, comprising:

(a) a jet pipe for discharging pressure water;

(b) pressure water supply means for supplying pressure water to said jet pipe;

(c) blocking means for selectively blocking and releasing a pressure water throughflow path between said jet pipe and said pressure water supply means, respectively;

(d) two trigger levers adapted for right-handed and left-handed actuation, respectively, and arranged to act on said blocking means so as to selectively block and release said pressure water throughflow path between said jet pipe and said pressure water supply means, respectively;

(e) said blocking means including a single blocking valve having a valve body, spring means biasing said valve body in a first direction, and a rocking member rotatably mounted on said valve body so that it extends in an unloaded condition in a second direction which is transverse to said first direction, said rocking member having two end regions spaced from one another in said transverse direction and cooperating with said trigger levers so that said blocking valve can open said pressure water through-flow path only when both said trigger levers simultaneously act on both said end regions of said rocking member, thereby to prevent high pressure spraying when only one of said trigger levers is actuated; and (f) at least one intermediate member arranged so that at least one of said trigger levers acts on a respective one of said end regions of said rocking member through said intermediate member;

(g) said rocking member being pivotable about a pivot point and having two end faces in said end regions, said intermediate member having an abutment face which is arranged to abut against one of said end faces of said rocking member and has a minimum distance to said pivot point, which is greater than a maximum distance from said end face in said one end region to said pivot point of said rocking member.

5. A high pressure spraying gun, comprising:

(a) a jet pipe for discharging pressure water;

(b) pressure water supply means for supplying pressure water to said jet pipe;

(c) blocking means for selectively blocking and releasing a pressure water throughflow path between said jet pipe and said pressure water supply means, respectively;

(d) two trigger levers for right-handed and left-handed actuation, respectively, and arranged to act on said blocking means so as to selectively block and release said pressure water throughflow path between said jet pipe and said pressure water supply means, respectively;

(e) said blocking means including a single blocking valve having a valve body, spring means biasing said valve body in a first direction, and a rocking member rotatably mounted on said valve body so that it extends in an unloaded condition in a second direction which is transverse to said first direction, said rocking member having two end regions spaced form one another in said transverse direction and cooperating with said trigger levers so that said blocking valve can open said pressure water throughflow path only when both said trigger levers simultaneously act on both said end regions of said rocking member, thereby to prevent high pressure spraying when only one of said trigger levers is actuated; and (f) control means arranged to hold said rocking member in a predetermined safety position.

6. A high pressure spraying gun as defined in claim 5; and further comprising a helical spring, said safety means including a spring-loaded pin which has one end face abutting against said rocking member, and another end face abutting against said helical spring.

7. A high pressure spraying gun as defined in claim 6 and further comprising a sleeve, said pin and said helical spring being guided in said sleeve.

8. A high pressure spraying gun, comprising:

(a) a jet pipe for discharging pressure water;

(b) pressure water supply means for supplying pressure water to said jet pipe;

(c) blocking means for selectively blocking and releasing a pressure water throughflow path between said jet pipe and said pressure water supply means, respectively;

(d) two trigger levers for right-handed and left-handed actuation, respectively, and arranged to act on said blocking means so as to selectively block and release said pressure water throughflow path between said jet pipe and said pressure water supply means, respectively;

(e) said blocking means including a single blocking valve having a valve body, spring means biasing said valve body in a first direction, and a rocking member pivotably mounted on said valve body so that it extends in an unloaded condition in a second direction which is transverse to said first direction, said rocking member having two end regions spaced form one another in said transverse direction and cooperating with said trigger levers so that said blocking valve can open said pressure water throughflow path only when both said trigger levers simultaneously act on both said end regions of said rocking member, thereby to prevent high pressure spraying when only one of said trigger levers is actuated; and (f) means including a pivot pin arranged in the region of said fork for holding said rocking member between said fork legs.

9. A high pressure spraying gun, comprising:

(a) a jet pipe for discharging pressure water;

(b) pressure water supply means for supplying pressure water to said jet pipe;

(c) blocking means for selectively blocking and releasing a pressure water throughflow path between said jet pipe and said pressure water supply means, respectively;

(d) two trigger levers for right-handed and left-handed actuation, respectively, and arranged to act on said blocking means so as to selectively block and release said pressure water throughflow path between said jet pipe and said pressure water supply means, respectively;

(e) said blocking means including a single blocking valve having a valve body, spring means biasing said valve body in a first direction, and a rocking member rotatably mounted on said valve body so that it extends in an unloaded condition in a second direction which is transverse to said first direction, said rocking member having two end regions spaced from one another in said transverse direction and cooperating with said trigger levers so that said blocking valve can open said pressure water through-flow path only when both said trigger levers simultaneously act on both said end regions of said rocking member, thereby to prevent high pressure spraying when only one of said trigger levers is actuated; and (f) a cup-shaped bush having a bottom wall with an outer bottom face, said valve body having a free end against which said outer bottom face abuts, said spring means including a pressure spring arranged inside said bush.

10. A high pressure spraying gun, comprising:

(a) a jet pipe for discharging pressure water;

(b) pressure water supply means for supplying pressure water to said jet pipe;

(c) blocking means for selectively blocking and releasing a pressure water throughflow path between said jet pipe and said pressure water supply means, respectively;

(d) two trigger levers for right-handed and left-handed actuation, respectively, and arranged to act on said blocking means so as to selectively block and release said pressure water throughflow path between said jet pipe and said pressure water supply means, respectively;

(e) said blocking means including a single blocking valve having a valve body, spring means biasing said valve body in a first direction, and a rocking member pivotably mounted on said valve body so that it extends in an unloaded condition in a second direction which is transverse to said first direction, said rocking member two end regions spaced from one another in said transverse direction and cooperating with said trigger levers so that said blocking valve can open said pressure water through-flow path only when both said trigger levers simultaneously act on both said end regions of said rocking member, thereby to prevent the high pressure spraying when only one of said trigger levers is actuated;

(f) control means arranged to hold said rocking member in a predetermined safety position;

(g) a helical spring, said safety means including a spring-loaded pin which has one end face abutting against said rocking member, and another end face abutting against said helical spring, (h) a sleeve within which said pin and said helical spring are guided; and (i) a cup-shaped bush having a bottom with an outer bottom face against which a free end of said valve body abuts against said outer bottom face, said spring means including a pressure spring arranged inside said bush, said sleeve having a side which faces toward said valve body and being provided at said side with a flange which abuts against said outer bottom face.

11. A high pressure spraying gun, comprising:

(a) a jet pipe for discharging pressure water;

(b) pressure water supply means for supplying pressure water to said jet pipe;

(c) blocking means for selectively blocking and releasing a pressure water throughflow path between said jet pipe and said pressure water supply means, respectively;

(d) two trigger levers for right-handed and left-handed actuation, respectively, and arranged to act on said blocking means so as to selectively block and release said pressure water throughflow path between said jet pipe and said pressure water supply means, respectively;

(e) said blocking means including a single blocking valve which has a valve body, spring means biasing said valve body in a first direction, and a rocking member rotatably mounted on said valve body so that it extends in an unloaded condition in a second direction which is transverse to said first direction, said rocking member having two end regions spaced from one another in said transverse direction and cooperating with said trigger levers so that said blocking valve can open said pressure water throughflow path only when both said trigger levers simultaneously act on both said end regions of said rocking member, thereby to prevent high pressure spraying when only one of said trigger levers is actuated;

(f) at least one intermediate member arranged so that at least one of said trigger levers acts on a respective one of said end regions of said rocking member through said intermediate member; and (g) a sleeve guided on said jet pipe, said one trigger lever having a plunger which is supported on said sleeve, said intermediate member being formed as a lever rod provided on said sleeve parallel to said jet pipe and having an end face which ends at said valve body in the region of said rocking member.

12. A high pressure spraying gun as defined in claim 11, wherein said sleeve has a free end face which faces away from said one trigger lever; and further comprising a pressure spring guided on said jet pipe; a housing accommodating said pressure spring, said free end face of said sleeve abutting against said spring.

13. A high pressure spraying gun, comprising:

(a) a jet pipe for discharging pressure water;

(b) pressure water supply means for supplying pressure water to said jet pipe;

(c) blocking means for selectively blocking and releasing a pressure water throughflow path between said jet pipe and said pressure water supply means, respectively; said (d) two trigger levers for right-handed and left-handed actuation, respectively, and arranged to act on said blocking means so as to selectively block and release said pressure water throughflow path between said jet pipe and said pressure water supply means, respectively;

(e) said blocking means including a single blocking valve having a valve body, spring means biasing said valve body in a first direction, and a rocking member rotatably mounted on said valve body so that it extends in an unloaded condition in a second direction which is transverse to said first direction, said rocking member having two end regions spaced from one another in said transverse direction and cooperating with said trigger levers so that said blocking valve can open said pressure water throughflow path only when both said trigger levers simultaneously act on both said end regions of said rocking member, thereby to prevent high pressure spraying when only one of said trigger levers is actuated;

(f) one of said trigger levers being a front trigger lever which is at least partially arranged about said jet pipe.

* * * * *